US006877455B2

(12) United States Patent
Hong

(10) Patent No.: US 6,877,455 B2
(45) Date of Patent: Apr. 12, 2005

(54) PREFABRICATED BOAT

(76) Inventor: Kwang Sun Hong, #419-2002 Areum Maeul 133(13/1) Imae-dong, Bundang-gu, Seongnam-shi, Kyeunggi-do, 463-732 (KR)

( * ) Notice: Subject to any disclaimer, the term of this patent is extended or adjusted under 35 U.S.C. 154(b) by 0 days.

(21) Appl. No.: 10/477,963

(22) PCT Filed: May 16, 2002

(86) PCT No.: PCT/KR02/00918

§ 371 (c)(1),
(2), (4) Date: Nov. 17, 2003

(87) PCT Pub. No.: WO02/092421

PCT Pub. Date: Nov. 21, 2002

(65) Prior Publication Data

US 2004/0144297 A1 Jul. 29, 2004

(30) Foreign Application Priority Data

May 17, 2001 (KR) ..... 2001-14482 U

(51) Int. Cl.[7] ..... B63B 5/24
(52) U.S. Cl. ..... 114/357; 114/345; 114/352
(58) Field of Search ..... 114/354, 352, 114/345, 357

(56) References Cited

U.S. PATENT DOCUMENTS 4,528,927 A * 7/1985 Iizuka et al. ..... 114/125
4,628,854 A 12/1986 Harding
5,228,407 A * 7/1993 Cummer et al. ..... 114/345
2002/0096101 A1 * 7/2002 Hansen ..... 114/345

FOREIGN PATENT DOCUMENTS

JP 57-10989 U 1/1982
JP 6-27490 U 4/1994
KR 99-001094 1/1999

* cited by examiner

*Primary Examiner*—Ed Swinehart
(74) *Attorney, Agent, or Firm*—Park & Sutton LLP; John K. Park

(57) ABSTRACT

The object of this invention is to provide a prefabricated boat consisting of a reinforced plastic boat body (1), and a rubber tube (2) detachably attached along each side of the body (1) to give buoyancy to the body (1). The sides of the boat body (1) each have a longitudinal guide groove (4) designed such that the tubes (2) are closely attached to the body (1) with enlarged contact surfaces between the tubes (2) and the body (1). Upper and lower brackets (6), each having a fitting groove (5), are formed along the upper and lower edges of each guide groove (4). Each tube (2) has two slidable fittings (7) engaging with the fitting grooves (5) of the two brackets (6). This boat thus minimizes hydraulic impact energy applied to the tubes (2) during a voyage, thus improving its sailing stability and cruising power as well as increasing its mileage.

1 Claim, 9 Drawing Sheets

PREFABRICATED BOAT

TECHNICAL FIELD

The present invention relates, in general, to prefabricated boats and, more particularly, to a prefabricated boat, which consists of a boat body formed of reinforced plastic group synthetic resins, with a rubber tube attached along each sidewall of the boat body to give buoyancy to the boat body, and both sidewalls of the boat body being designed such that the tubes are closely attached to said sidewalls with enlarged contact surfaces between the tubes and the boat body, and which thus minimizes hydraulic impact applied to the tubes due to frictional resistance of water during a voyage, thereby improving its sailing stability and cruising power as well as increasing its mileage.

BACKGROUND ART

As well known to those skilled in the art, rubber boats are designed such that they expand to form predetermined shapes when being inflated with compressed air, and float in the water due to buoyancy exerted by the water in which the inflated boat bodies are immersed. Such rubber boats are easy to carry and store out of use, so they are widely and preferably used as leisure boats and rescue boats.

However, the rubber boats are made of rubber which is easily cut or torn, so the inflated boat bodies of the rubber boats are often seriously damaged upon impact during a voyage or colliding against sharp edges or sharp points when being at anchor in the harbor. Therefore, such rubber boats sometimes present safety hazards resulting in loss of lives in the case of careless management of them. The rubber boats are thus inferior in terms of safety, and force persons boarding the boats to carefully manage the boats, thus being inconvenient to the persons during a voyage or while being at anchor in the harbor.

Another problem of the rubber boat resides in that the boat bodies are made of soft rubber, so the boats cannot offer stability or comfort to persons boarding the boats. The rubber boats also experience severe frictional resistance from water during a voyage, thereby undesirably reducing mileage in the case of motorboats.

In an effort to provide a boat that overcomes the above-mentioned disadvantages experienced in the conventional rubber boats in addition to retaining the advantages of the rubber boats, the inventor of the present invention proposed a prefabricated boat that consists of a boat body formed of reinforced plastics, with rubber tubes attached along both sides of the plastic boat body to increase buoyancy of the body, in Korean Patent Application No. 98-14548.

FIG. 9 is an exploded perspective view of the above-mentioned prefabricated boat. In the prefabricated boat, the front part 11 of the deck 13 of a boat body 10 made of reinforced plastic group synthetic resins is projected laterally outward along each side edge, thus enlarging contact surfaces between the rubber tubes 20 and the body 10. Upper and lower tube locking recesses 30, each consisting of a fitting inlet end 32 and a longitudinal groove 31, are formed along the upper and lower portions of each sidewall 12 of the boat body 10 in such a way that the inlet end 32 of the lower locking recess is positioned in back of the front part 11. The rubber tubes 20 each have upper and lower slidable fittings 21 at positions corresponding to the upper and lower locking recesses 30 of each sidewall 12 of the boat body 10. Therefore, the rubber tubes 20 are thus detachably attached to both sides of the boat body 10 through a detachable engagement of the tubes' fittings 21 with the body's locking recesses 30. Each of the above rubber tubes 20 has a longitudinal cylindrical shape, and is streamlined at its front portion to create a typical projectile shape, and is attached along each side of the boat body 10 such that the pointed front end of the rubber tube 20 is directed toward the front part 11 of the boat body 10.

Therefore, the prefabricated boat with rubber tubes enlarges the size of the boat body's front part 11, to which frictional resistance exerted by the water is concentrated during a voyage. The boat thus minimizes possibility of damage to rubber tubes which cannot effectively endure frictional impact due to intrinsic properties of rubber, and attenuates the rolling of the boat body, different from conventional boats made of boards, so the boat gives stability and comfort to persons boarding the boat as well as improving safety during a voyage. However, the conventional prefabricated boat having rubber tubes has several problems as follows.

First, when the rubber tubes are attached to both sides of the boat body through a detachable engagement of the tubes' fittings with the boat body's locking recesses, most parts of the tubes except for the fittings are directly exposed to the outside of both sides of the boat body, so the surface contact areas between the tubes and both sidewalls of the boat body are limited to the fittings of the tubes. Therefore, when hydraulic frictional resistance is continuously exerted to the rubber tubes by the water during a voyage of the boat, hydraulic impact caused by the frictional resistance repeatedly stresses the areas of the tubes around the fittings, thus quickly damaging the tubes.

Second, the prefabricated boat does not have any means for absorbing and dispersing impact energy caused by the hydraulic frictional resistance exerted to the tubes by the water, so persons aboard the boat suffer from severe pitching of the boat body during a voyage. The boat is thus degraded in its sailing stability and cruising power, as well as its mileage.

DISCLOSURE OF THE INVENTION

Accordingly, the present invention has been made keeping in mind the above problems occurring in the prior art, and an object of the present invention is to provide a prefabricated boat, which consists of a boat body formed of reinforced plastic group synthetic resins, with a rubber tube attached along each sidewall of the boat body to increase buoyancy of the boat body, and both sidewalls of the boat body being designed such that the tubes are closely attached to the sidewalls with enlarged contact surfaces between the tubes and the boat body, and which thus minimizes hydraulic impact applied to the tubes due to frictional resistance exerted on the tubes by the water during a voyage, thereby improving its sailing stability and cruising power as well as increasing its mileage.

In order to accomplish the above object, the present invention provides a prefabricated boat, comprising a reinforced plastic boat body, and a rubber tube attached along each side of the boat body to increase buoyancy of the boat body, wherein a longitudinal guide groove is formed along each sidewall of the boat body by longitudinally recessing the sidewall, with the rubber tube being attached to the boat body along the longitudinal guide groove while being partially received in the guide groove. In addition, upper and lower brackets are formed along the upper and lower edges of the longitudinal guide groove on each sidewall of the boat body, with a fitting groove being formed along each of the upper and lower brackets, and a slidable fitting is formed on the external surface of the rubber tube at a position corresponding to the fitting groove of each of the upper and lower brackets and slidably engages with the fitting groove.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
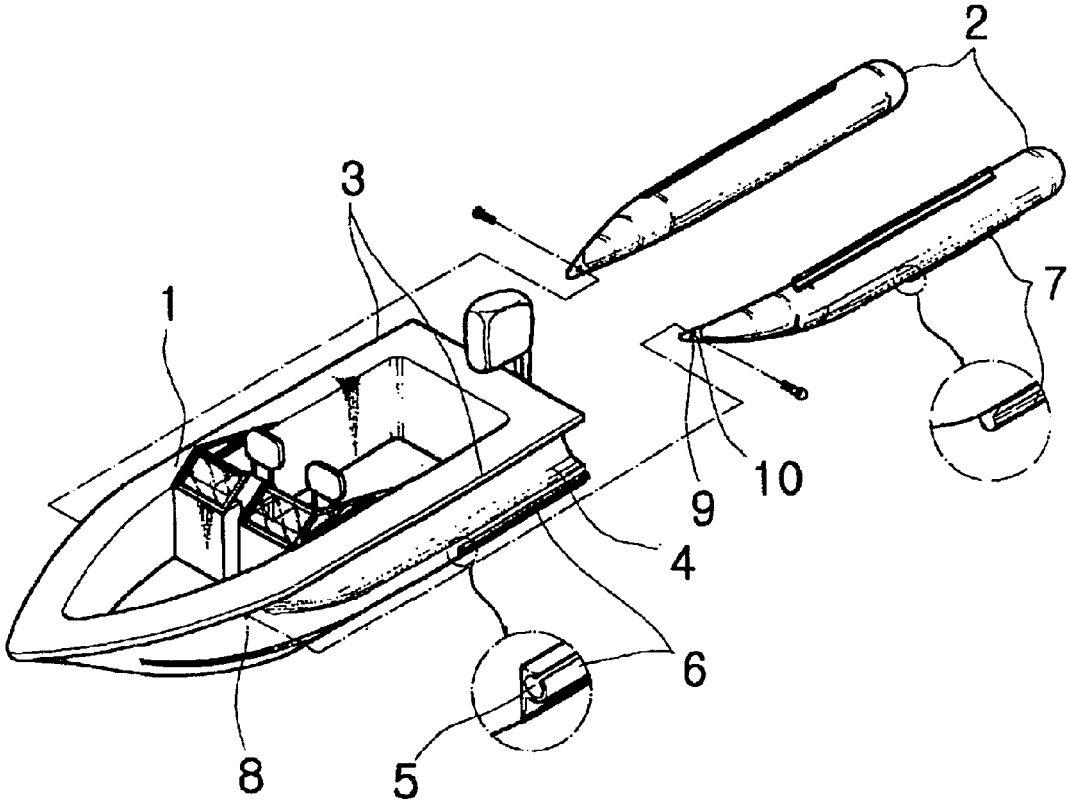
FIG. 1 is a perspective view of a prefabricated boat in accordance with the primary embodiment of the present invention, with two rubber tubes disassembled from the boat body.

Reference should now be made to the drawings, in which the same reference numerals are used throughout the different drawings to designate the same or similar components.

Figure 2:
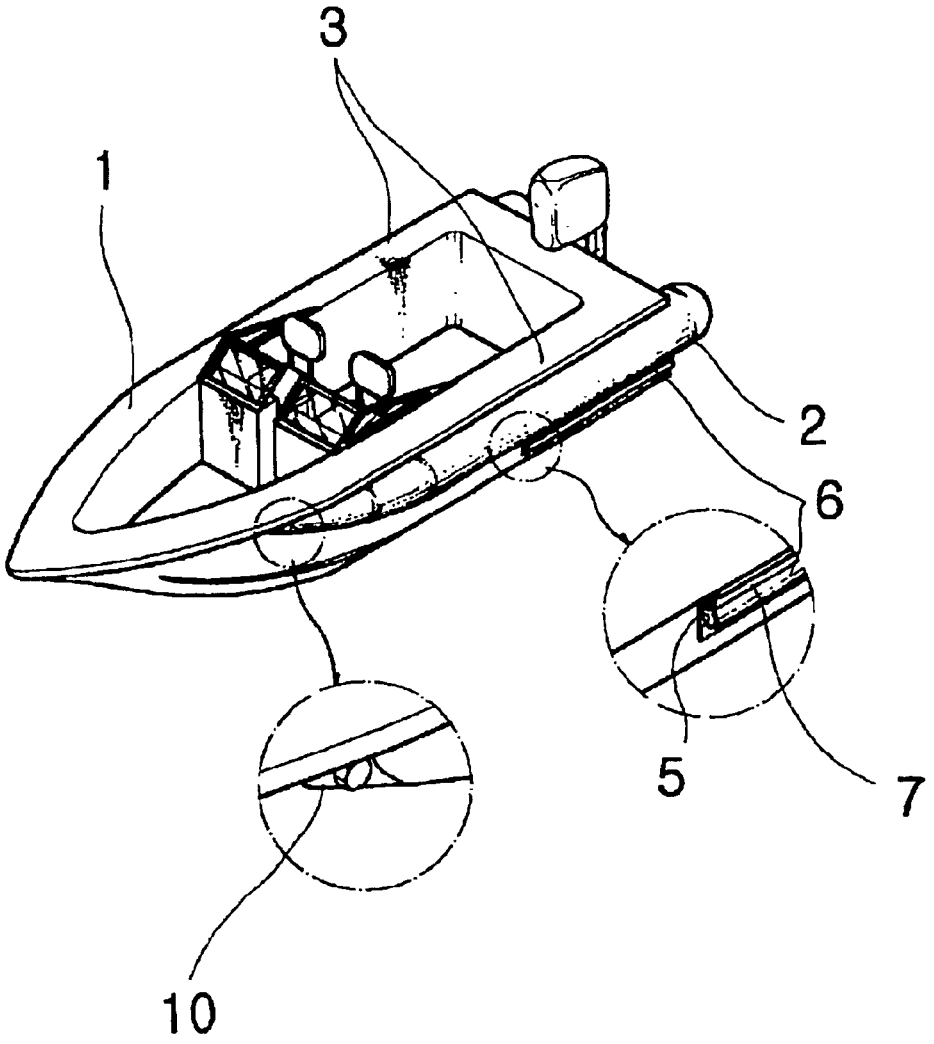
FIG. 2 is a perspective view of the prefabricated boat according to the present invention, with the two rubber tubes completely attached to both sides of the boat body.
Figure 3:
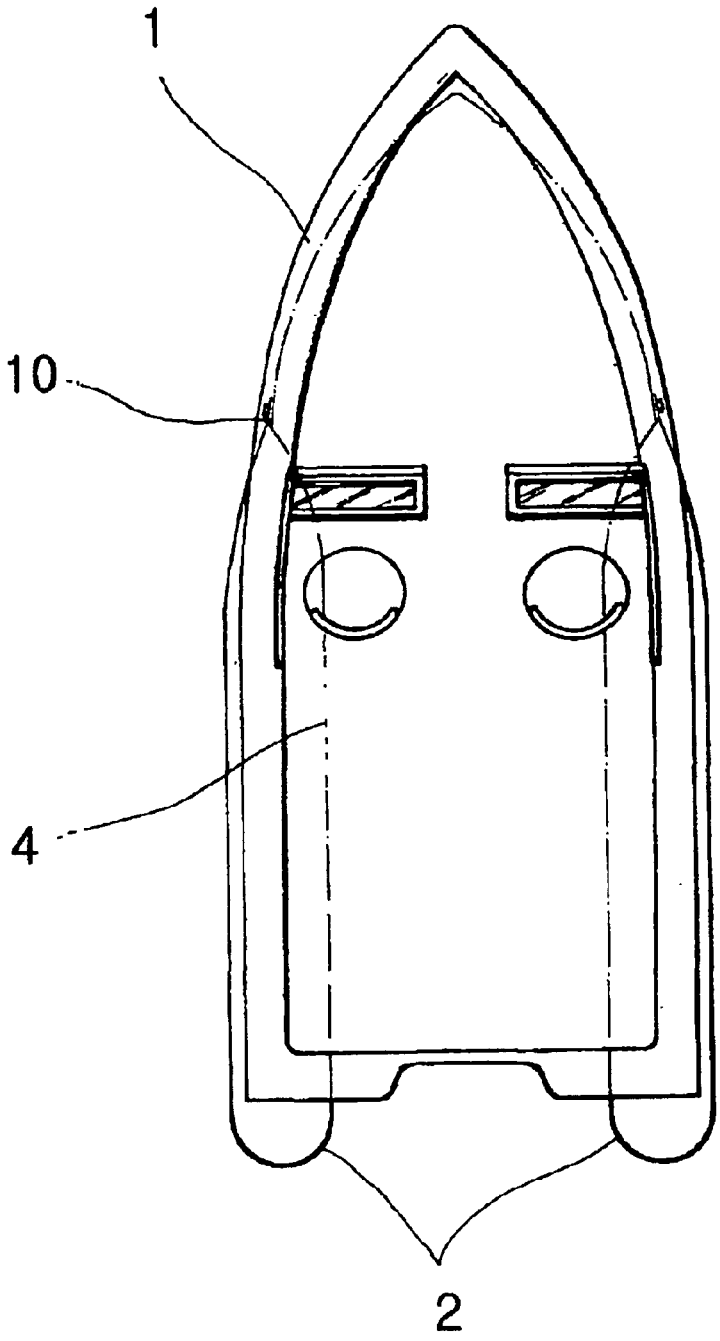
FIG. 3 is a plan view of the prefabricated boat according to the present invention, showing the profile of the boat with the two rubber tubes attached to both sides of the boat body.
Figure 4:
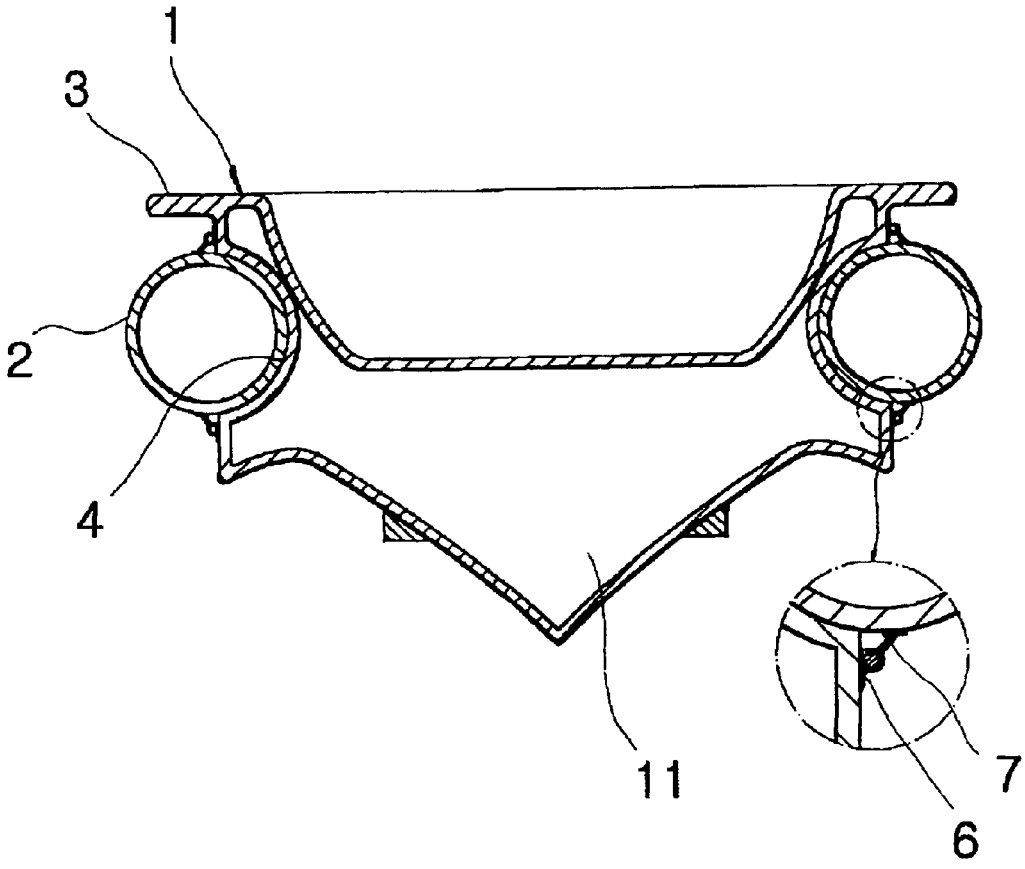
FIG. 4 is a sectional view of the prefabricated boat according to the present invention, showing the structure for locking the rubber tubes to both sides of the boat body.
Figure 5:
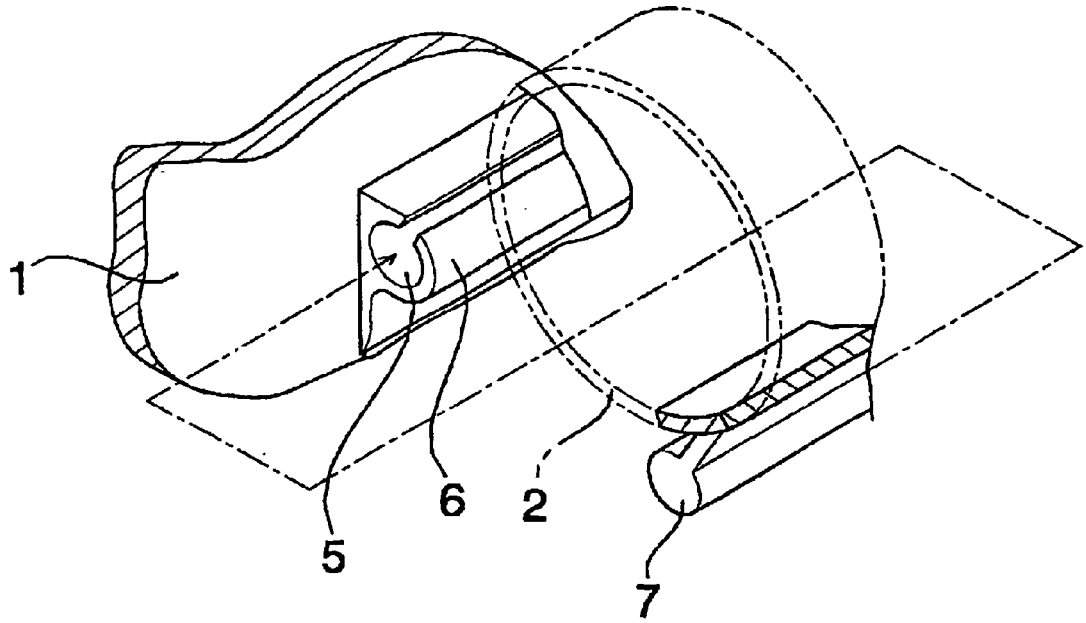
FIG. 5 is an exploded perspective view of important parts of the locking structure of FIG. 4, with a fitting groove formed on each sidewall of the boat body and a slidable fitting formed on each rubber tube.

FIGS. 1 and 2 are perspective views of a prefabricated boat in accordance with the primary embodiment of the present invention, showing a tube-disassembled state and a tube-assembled state, respectively. FIG. 3 is a plan view of the prefabricated boat of the present invention, showing the profile of the boat in the tube-assembled state. FIGS. 4 and 5 are a sectional view and an exploded perspective view, respectively, showing a structure for locking the rubber tubes to both sides of the boat body of the present invention.

As shown in the drawings, the prefabricated boat according to the primary embodiment comprises a reinforced plastic boat body 1 having a streamlined shape, and a rubber tube 2 attached along each side of the boat body 1 to increase buoyancy of the boat body 1. The deck 3 of the boat body 1 is projected laterally outward along each side edge extending from the bow to the stern thereof. A longitudinal guide groove 4 is formed along each sidewall of the boat body 1 by longitudinally recessing the sidewall, with the rubber tube 2 being attached to the boat body 1 along the longitudinal guide groove 4 while being partially received in the groove 4.

In the prefabricated boat, upper and lower brackets 6 are formed along the upper and lower edges of the longitudinal guide groove 4 on each sidewall of the boat body 1. A fitting groove 5 is formed along each of the upper and lower brackets 6 to stably attach the rubber tube 2 to the sidewall of the boat body 1. A slidable fitting 7 is longitudinally formed on the external surface of the rubber tube 2 at a position corresponding to the fitting groove 5 of each of the upper and lower brackets 6 and slidably engages with the fitting groove 5. In order to secure desired locking force at the junctions of the slidable fittings 7 of the rubber tube 2 and the fitting grooves 5 of the brackets 6, it is preferable to design each fitting groove 5 having a loop-shaped cross-section capable of firmly holding the rail part of the slidable fitting 7.

The longitudinal guide groove 4 formed along each sidewall of the boat body 1 gradually deepens in a direction from the bow to the stern due to the streamlined shape of the boat body 1. A first locking hole 8 is formed on each sidewall of the boat body 1 at a position on each of port and starboard sides around the front end of the longitudinal guide groove 4 to lock the front end of the rubber tube 2 to the boat body 1. A locking part 10 is provided at the front end of the rubber tube 2. The locking part 10 is made of a durable material, with a second locking hole 9 formed on the locking part 10 at a position corresponding to the first locking hole 8 of the boat body 1. When attaching the rubber tube 2 to each side of the boat body 1, the locking part 10 of the rubber tube 2 is attached to the first locking hole 8 on each side of the boat body 1 by threading a locking bolt into the first and second locking holes 8 and 9 after aligning the two locking holes 8 and 9.

The operational effect of the present invention will be described herein below.

Figure 6:
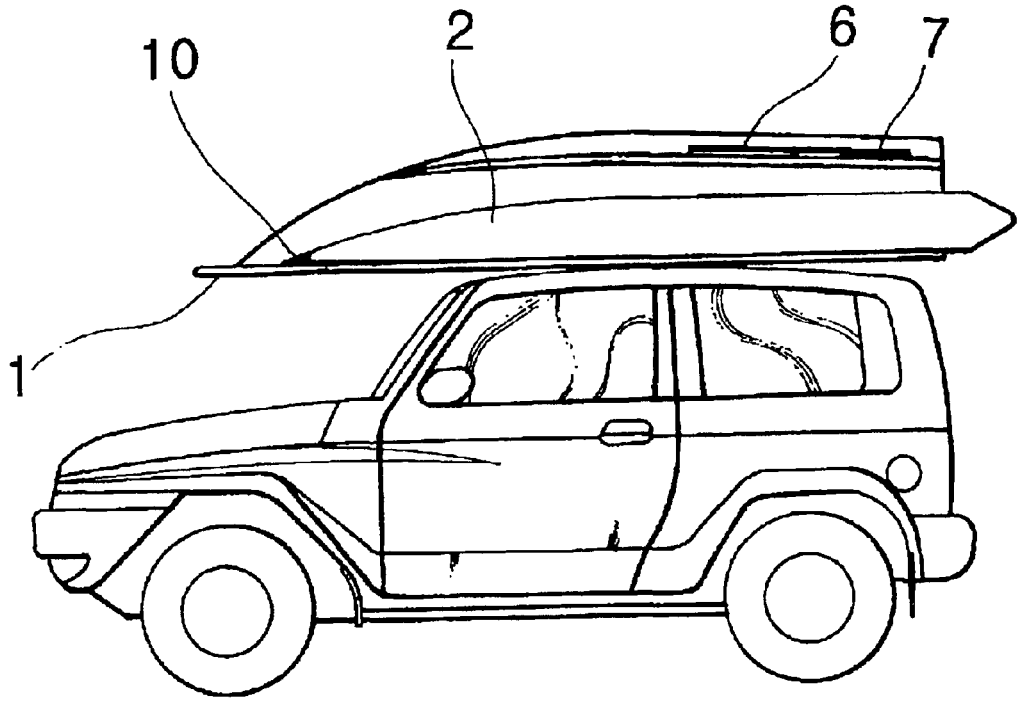
FIG. 6 is a view showing the boat of the present invention loaded on the roof of a station wagon for transportation to a desired place.

FIG. 6 is a view showing the boat of the present invention that is loaded on the roof of a station wagon for transportation to a desired place.

The inflated rubber tubes 2 are attached to both sides of the boat body 1 along the guide grooves 4, thus increasing buoyancy of the boat body 1. In such a case, a part of each rubber tube 2 is received in the guide groove 4 to a predetermined depth, while the remaining part of the rubber tube 2 is exposed outside the sidewall of the boat body 1. Therefore, the inflated rubber tubes 2 attached to the boat body 1 effectively increase buoyancy of the boat body 1 by their entire volumes, but the exposed parts of the tubes 2, to which frictional resistance is exerted by the water during a voyage, are reduced in their volumes such that the frictional resistance from the water is reduced by the volumes received in the guide grooves 4. The prefabricated boat of the present invention thus has increased buoyancy and reduced frictional resistance of water during a voyage, which synergistically improves sailing stability and cruising power of the boat, as well as increasing mileage.

Furthermore, the parts of the rubber tubes 2 received in the guide grooves 4 reduce a possibility of damage to the rubber tubes 2, so the expected life span of the rubber tubes 2 can be lengthened. The contact force acting at the junctions of the rubber tubes 2 and the boat body 1 is increased due to the enlarged contact surface area between the boat body 1 and the rubber tubes 2, so it is possible to minimize rolling of the boat during a voyage.

In addition, the top portions of the exposed parts of the rubber tubes 2 on both sides of the boat body 1 are covered with the projecting edges of the deck 3, so the top portions of the tubes are protected from damage caused by contact with persons boarding or leaving the boat. It is thus possible to enhance safety of the boat and lengthen the life span of the tubes.

When attaching a rubber tube 2 to each side of the boat body 1, the locking part 10 of the rubber tube 2 is attached to the first locking hole 8 on each side of the boat body 1 by threading a locking bolt into the second locking hole 9 of the locking part 10 and the first locking hole 8 sequentially after aligning the two locking holes 8 and 9. Therefore, it is possible to firmly lock the front ends of the rubber tubes 2 to the boat body 1 while compensating for inferior contact force of said tubes' front ends positioned at the shallow front ends of the guide grooves 4.

In addition, since the inflated rubber tubes 2 are attached along the sidewalls of the boat body 1 such that the boat with the tubes 2 does not experience severe wind resistance, the boat can be moved to a desired place while being loaded on the roof of a vehicle without disassembling the rubber tubes from the body 1, as shown in FIG. 6, in the same manner as conventional rubber boats. Therefore, the prefabricated boat is easily and quickly transported to a desired place.

Figure 7:
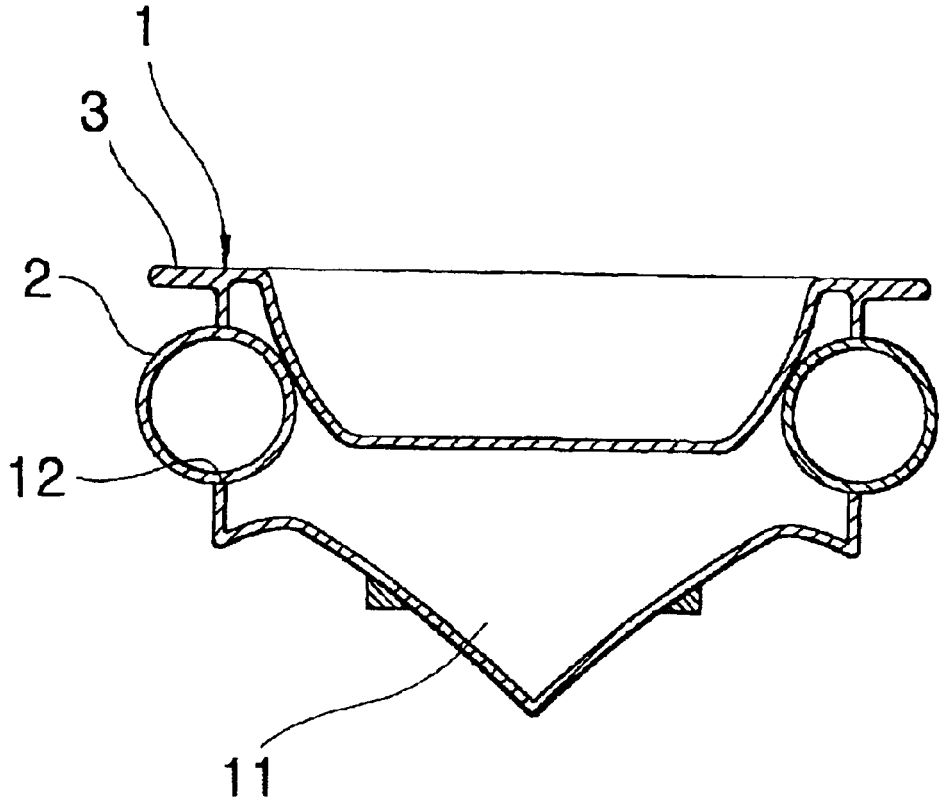
FIG. 7 is a sectional view of the boat body of a prefabricated boat according to the second embodiment of the present invention.
Figure 8:
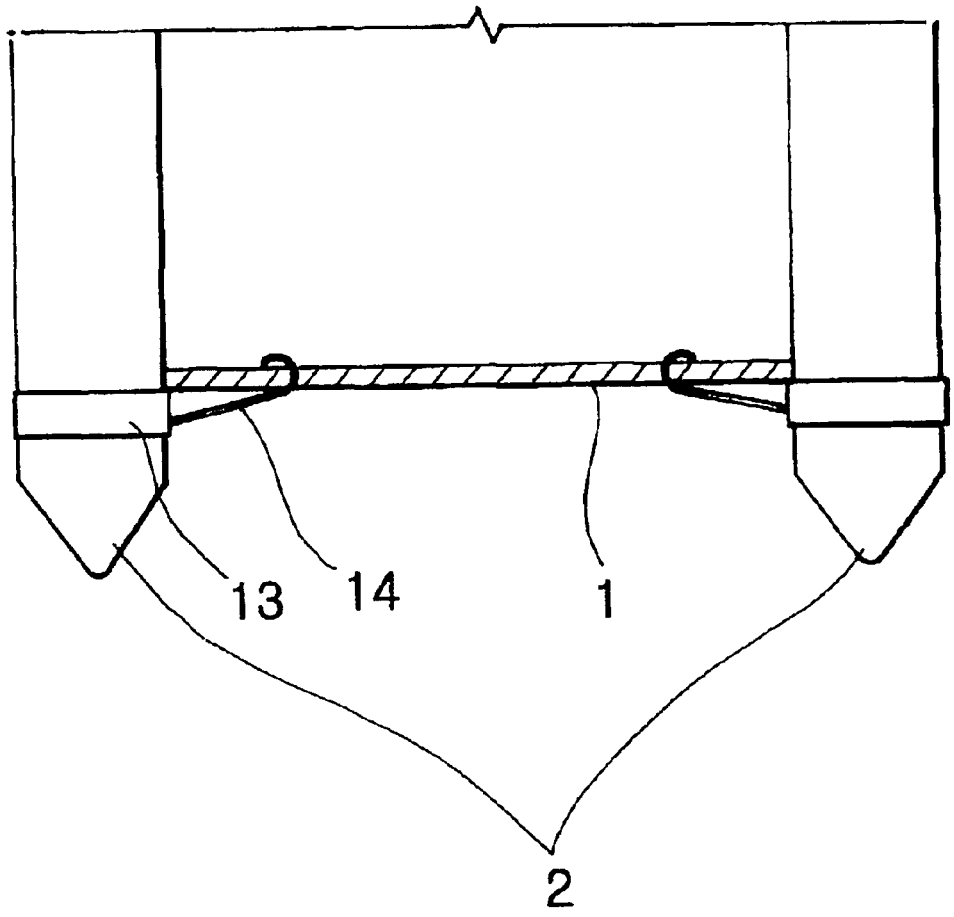
FIG. 8 is a plan view of the rear part of the prefabricated boat according to the second embodiment, showing a structure for locking two rubber tubes to the stern of the boat body.
Figure 9:
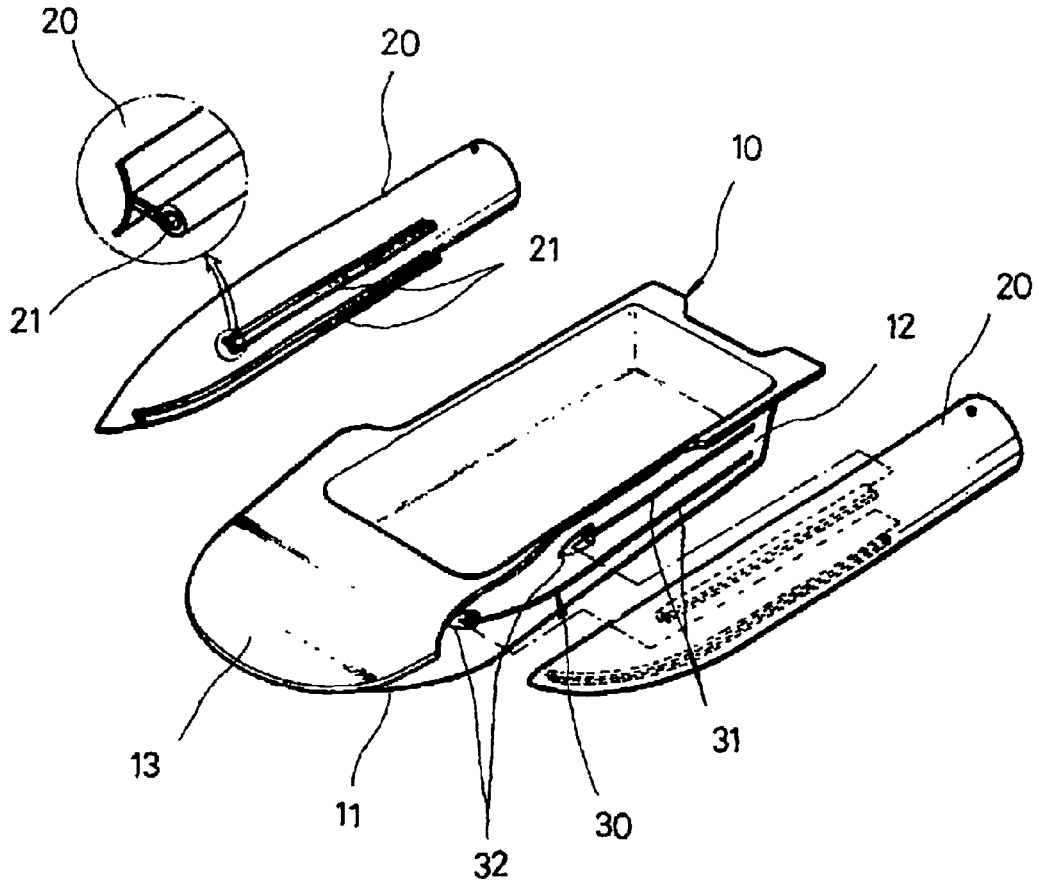
FIG. 9 is a perspective view of a conventional prefabricated boat, with two rubber tubes disassembled from the boat body.

FIGS. 7 and 8 are a sectional view and a plan view of a prefabricated boat according to the second embodiment of the present invention. As shown in the drawings, the prefabricated boat of the second embodiment is designed such that a longitudinal tube-seating hole 12 is integrally formed in each sidewall of the boat body 1 and a rubber tube 2 is removably inserted into the tube-seating hole 12 of each sidewall. The two tube-seating holes 12 communicate with a cavity 11 of the boat body 1, but the rubber tubes 2 inserted in the tube-seating holes 12 prevent water from flowing into the cavity 11 through the holes 12.

The prefabricated boat according to the second embodiment yields the same operational effect as that described for the primary embodiment. Furthermore, the second embodiment collaterally conserves the material of the boat body 1.

The two rubber tubes 2 inserted in the two tube-seating holes 12 are firmly fastened to the stern of the boat body 1 by using belts 13 and fastening loops 14, so it is possible to minimize vibration of the tubes' rear parts during a voyage. The prefabricated boat of the second embodiment has enhanced sailing stability and cruising power as well as increased mileage.

INDUSTRIAL APPLICABILITY

As described above, the present invention provides a prefabricated boat consisting of a boat body made of reinforced plastic group synthetic resins, and a rubber tube detachably attached along each side of the boat body to increase buoyancy of the body. The sides of the boat body each have a longitudinal guide groove designed such that the rubber tubes are closely attached to the boat body while being partially received in the grooves, thus minimizing the size of exposed parts of the rubber tubes which experience severe frictional resistance from water during a voyage of the boat. The boat of the present invention has desired buoyancy, and improved sailing stability and cruising power as well as increased mileage. Therefore, the quality and market competitiveness of the prefabricated boat is enhanced.

What is claimed is:

1. A prefabricated boat, comprising a reinforced plastic boat body having a streamlined shape, and a rubber tube attached along each side of the boat body to increase buoyancy of said boat body, wherein a deck of said boat body is projected laterally outward along each side edge extending from a bow to a stern thereof; and a longitudinal guide groove is formed along each sidewall of said boat body by longitudinally recessing the sidewall, with the rubber tube being attached to the boat body along said longitudinal guide groove while being partially received in said guide groove, and upper and lower brackets are formed along upper and lower edges of the longitudinal guide groove on each sidewall of the boat body, with a fitting groove being formed along each of the upper and lower brackets to attach the rubber tube to the sidewall of the boat body; and a slidable fitting is formed on an external surface of the rubber tube at a position corresponding to the fitting groove of each of the upper and lower brackets and slidably engages with the fitting groove, and wherein a first locking hole is formed on each sidewall of the boat body at a position on each of port and starboard sides around a front end of the longitudinal guide groove to lock a front end of the rubber tube to the boat body; and a locking part is provided at the front end of the rubber tube, said locking part being made of a durable material and having a second locking hole, whereby said locking part of the rubber tube is attached to the first locking hole of the boat body by using a locking bolt.

* * * * *